US008820487B2

(12) United States Patent
Bowman et al.

(10) Patent No.: US 8,820,487 B2
(45) Date of Patent: Sep. 2, 2014

(54) ROPE ARRESTING APPARATUS

(71) Applicant: Kearney-National Inc., New York, NY (US)

(72) Inventors: Joseph M. Bowman, Abingdon, VA (US); Charles R. Huffman, Jr., Kingsport, TN (US)

(73) Assignee: Kearney-National Inc., New York, NY (US)

( * ) Notice: Subject to any disclaimer, the term of this patent is extended or adjusted under 35 U.S.C. 154(b) by 50 days.

(21) Appl. No.: 13/688,909

(22) Filed: Nov. 29, 2012

(65) Prior Publication Data

US 2014/0144729 A1 May 29, 2014

(51) Int. Cl.

| | |
|---|---|
| ***A62B 1/14*** | (2006.01) |
| ***A62B 1/06*** | (2006.01) |
| ***A63B 29/02*** | (2006.01) |

(52) U.S. Cl.

CPC .. *A62B 1/06* (2013.01); *A63B 29/02* (2013.01)

USPC ..... 188/65.1; 182/5

(58) Field of Classification Search

USPC ..... 188/65.1–65.5; 182/5, 7, 192, 193; 160/178.2

See application file for complete search history.

(56) References Cited

U.S. PATENT DOCUMENTS

| | | | | |
|---|---|---|---|---|
| 15,290 | A | 7/1856 | Fuzzard | |
| 950,952 | A | 3/1910 | Perrott | |
| 1,794,873 | A | 3/1931 | Thoroman | |
| 2,627,834 | A | 2/1953 | Roberts et al. | |
| 2,645,283 | A | 7/1953 | Johansson | |
| 3,204,311 | A | 9/1965 | Laviano | |
| 3,300,185 | A | 1/1967 | Mietzger et al. | |
| 3,931,846 | A | 1/1976 | Zilver | |
| 3,976,283 | A | 8/1976 | Schmit | |
| 4,097,023 | A * | 6/1978 | Muller | 254/391 |
| 4,648,483 | A | 3/1987 | Skyba | |
| 5,096,022 | A | 3/1992 | Bowers | |
| 5,133,111 | A | 7/1992 | Brown | |
| 5,479,870 | A | 1/1996 | Corzine | |
| 5,664,640 | A | 9/1997 | Smith | |
| 5,931,263 | A * | 8/1999 | Ericson et al. | 187/373 |
| 7,073,780 | B2 | 7/2006 | Stone | |
| 7,451,720 | B2 | 11/2008 | Somers | |
| 7,775,254 | B2 * | 8/2010 | Judkins et al. | 160/178.2 |

* cited by examiner

*Primary Examiner* — Christopher Schwartz

(74) *Attorney, Agent, or Firm* — Buchanan Ingersoll & Rooney

(57) ABSTRACT

A rope arresting apparatus for use with a rope having a first end and a weighted second end is disclosed. The rope arresting apparatus includes a cam portion for exerting frictional force on the rope and a pinching portion. The cam portion has a resting position and a pinching position. At the resting position, the cam portion is in frictional contact with the rope when the tension on the weighted second end of the rope is less than or equal to tension on the first end of the rope. A pinching point is formed when the cam portion at the pinching position engages the rope against the pinching portion.

19 Claims, 3 Drawing Sheets

ROPE ARRESTING APPARATUS

BACKGROUND

The present disclosure pertains to a rope arresting apparatus for use with weighted ropes that more automatically assists the user in setting and releasing the apparatus. Previous designs in the industry often require the user to manually set an arresting mechanism in order to prevent free-fall of a weighted rope. This may be difficult for the user because he or she must continue to hold the weighted rope while the arresting mechanism is engaged. This complicates operation and reduces reliability of the arresting mechanism as well as its overall ease-of-use. The disclosed rope arresting apparatus addresses these and other problems of previous designs by aiding user efficiency.

SUMMARY

Accordingly, an object of the disclosure is to provide a rope arresting apparatus for securing a weighted rope.

A further object of the disclosure is to provide a rope arresting apparatus that secures the rope independent of any user action or inaction.

A further object of the disclosure is to provide a rope arresting apparatus that releases the rope due to an action by the user.

A further object of the disclosure is to provide a rope arresting apparatus that is simple and convenient to use.

A further object of the disclosure is to provide a rope arresting apparatus that is simple and convenient to manufacture.

To achieve the above objects and others, a rope arresting apparatus comprises a cam portion, a pinching portion, and a pinching point. The pinching point is formed when the cam portion at the pinching position engages the rope against the pinching portion. Frictional contact at the pinching point secures the weighted rope and prevents further free fall.

DRAWINGS

Figure 5A:
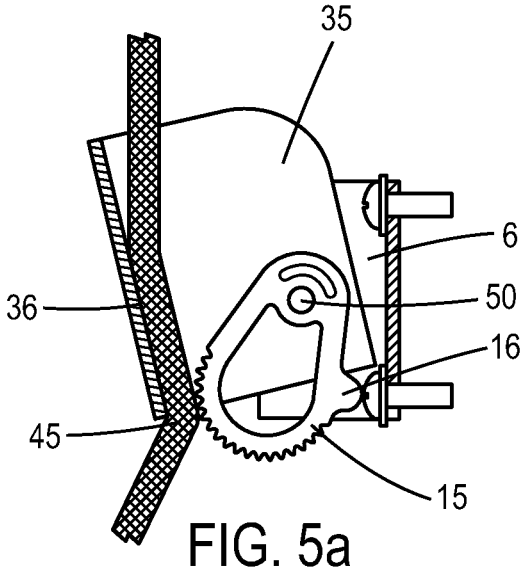

FIG. 5*a* depicts an embodiment of the rope arresting apparatus forming a pinching point with the pinching portion at a first pinching portion position.

Figure 5B:
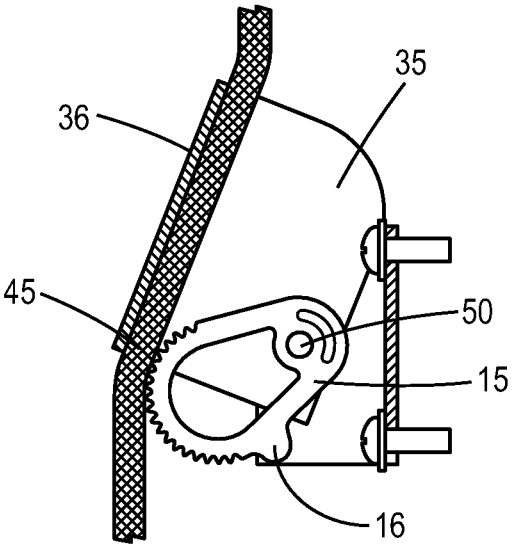

FIG. 5*b* depicts an embodiment of the rope arresting apparatus forming a pinching point with the pinching portion at a second pinching portion position.

Figure 6:
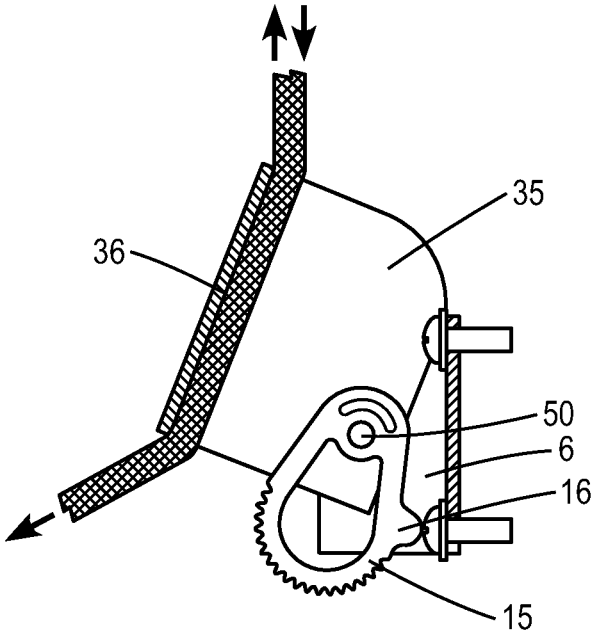

FIG. 6 depicts an embodiment of the rope arresting apparatus in a released state.

DETAILED DESCRIPTION

The rope arresting apparatus is particularly suited for use in systems with weighted ropes, as typically found in lifting apparatuses for flags and the like. The rope arresting apparatus comprises at least a cam portion, a pinching portion, and a pinching point. The cam portion is configured to exert frictional force on the rope. The cam portion has a resting position and a pinching position. At the resting position, the cam portion is configured to be in frictional contact with the rope. At the pinching position, the cam portion is configured to cooperate with a pinching portion to form a pinching point when the cam portion at the pinching position engages the rope against the pinching portion.

Figure 1:
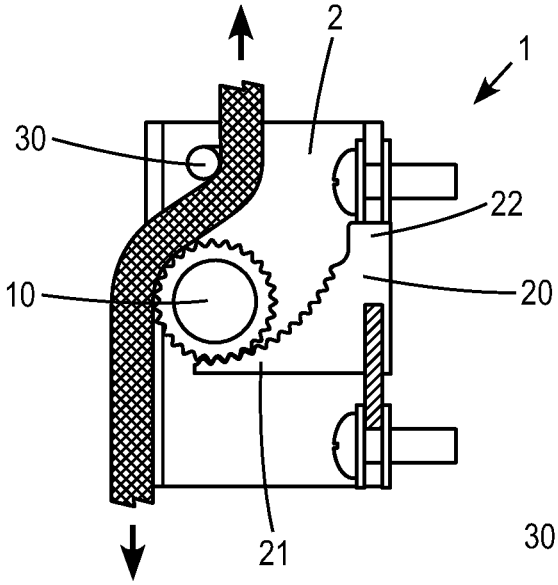
FIG. 1 depicts an embodiment of the rope arresting apparatus in an initial state.

In an exemplary embodiment depicted in FIG. 1, the rope arresting apparatus 1 includes a housing 2 within which a cam portion 10, cam ramp 20, and a pinching portion 30 are placed. The housing 2 is fixed to a mounting surface. The housing 2 includes appropriate cutaway portions to allow the user to access the rope while still maintaining the cam portion 10, cam ramp 20, and pinching portion 30 in their respective positions.

The cam portion of the current exemplary embodiment will now be described. The cam portion 10 is arranged to traverse the cam ramp 20 while remaining within the housing 2. The cam portion 10 has a width less than the inner width of the housing 2 but greater than the width of the cam ramp 20. In further embodiments, the cam portion may be an unsecured roller, tube, cylinder, or other shape suitable for traversing the cam ramp and for forming a pinching point with the pinching portion. In still further embodiments, the cam portion may include a set of surface protrusions of a predetermined size and length for exerting frictional force on the rope. The surface protrusions may be arranged in a manner that does not damage the rope while exerting frictional force. The cam portion surface protrusions may be arranged on the cam portion longitudinally, laterally, or in any orientation in between, to provide the appropriate frictional force for securing the rope. The surface protrusions themselves may be formed by knurling or other known manufacturing processes.

Figure 2:
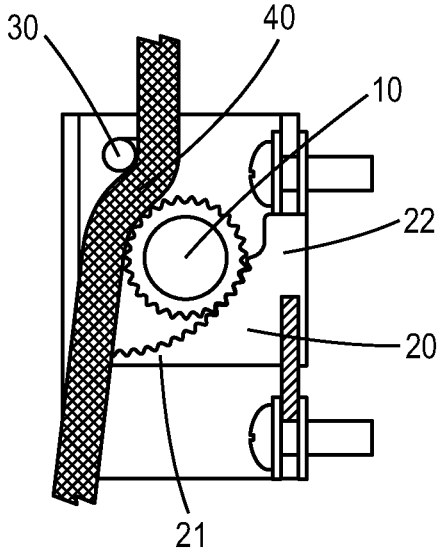
FIG. 2 depicts an embodiment of the rope arresting apparatus in a pinching state.
Figure 3:
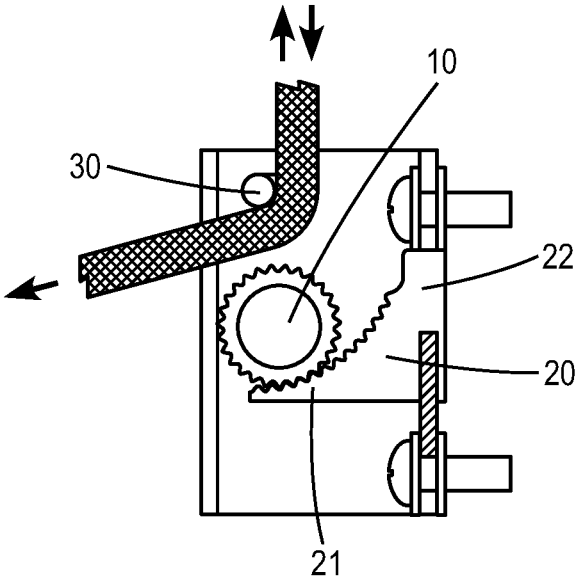
FIG. 3 depicts an embodiment of the rope arresting apparatus in a released state.

The cam ramp of the current exemplary embodiment will now be described. The cam ramp 20 is secured in the housing 2 and includes a proximate end 21 and a remote end 22 as shown in FIGS. 1-3. The cam ramp 20 has a width less than the inner width of the housing 2. The proximate end 21 of the cam ramp 20 is arranged to allow the cam portion 10 at the resting position to remain in frictional contact with the rope. The remote end 22 of the cam ramp 20 is arranged to allow the cam portion 10 at the pinching position to form a pinching point 40 with the pinching portion 30 and the rope. In further embodiments, the cam ramp may include surface protrusions to reduce slippage of the cam portion. In still further embodiments, the cam ramp surface protrusions may correspond to surface protrusions on a cam portion to reduce slippage of the cam portion.

The pinching portion of the current exemplary embodiment will now be described. The pinching portion 30 is mounted in the housing 2 so that a pinching point 40 is formed with the cam portion 10 when the cam portion 10 is at the pinching position. In the current embodiment, the pinching portion 30 is mounted in an oblong mounting point to facilitate installation. The pinching portion 30 of this embodiment is removed when attaching the housing 2 to the mounting surface and when inserting the rope into the rope arresting apparatus. The pinching portion 30 is then inserted into the oblong mounting point. The oblong mounting point provides extra lateral space so that the pinching portion 30 may be easily inserted without interfering with the other components of the rope arresting apparatus. In the current embodiment, the pinching portion 30 will always move to the far end of the oblong mounting point away from the cam portion 10 after the cam portion 10 has engaged with the rope and the pinching portion 30. In further embodiments, the pinching portion may be a pin, a roller, or other structures known in the art suitable for providing a corresponding surface to the cam portion to form a pinching point. In further embodiments, the mounting point may be formed in another shape that also provides adequate lateral space so that the pinching portion 30 may be easily inserted during assembly. In still further embodiments, the pinching portion may include a set of surface protrusions of a predetermined size and length that are arranged on the pinching portion longitudinally, laterally, or in any orientation in between. The pinching portion surface protrusions may be arranged to provide the appropriate amount of frictional force for securing the rope while not damaging the rope. The pinching portion surface protrusions may be formed by knurling or other known manufacturing processes.

The pinching point in the current exemplary embodiment will now be described. The pinching point 40 is where the cam portion 10 and the pinching portion 30 cooperate to secure the rope and prevent the rope from sliding further towards the weighted second end of the rope. The pinching point 40 is formed when the cam portion 10 is urged towards the weighted second end of the rope while tension on the second end of the rope is greater than tension at the first end of the rope, as depicted in FIG. 2. The pinching portion 30 is arranged to provide a corresponding surface to the cam portion 10 and help provide friction to secure the rope. When tension on the second end of the rope is no longer greater than tension on the first end of the rope, the pinching point 40 may be unformed, causing the cam portion 10 to move from the pinching position at approximately the remote end 22 of the cam ramp 20 and return to the resting position at approximately the proximate end 21 of the cam ramp 20, as depicted in FIG. 3. The cam portion 10 may be secured in the pinching position so that the pinching point 40 is not immediately unformed when tension on the weighted second end of the rope is no longer greater than tension on the first end of the rope. Appropriate tension must then be applied at the first end of the rope to overcome the securing force at the pinching point 40, thereby unforming the pinching point 40 and releasing the cam portion 10.

The mode of operation of the current exemplary embodiment will now be described. The cam portion 10 at the resting position remains in frictional contact with the rope at approximately the proximate end 21 of the cam ramp 20. The cam portion 10 maintains the resting position while tension on the weighted second end of the rope is less than or equal to tension on the first end of the rope. As tension on the weighted second end of the rope increases and becomes greater than tension on the first end of the rope, the rope's movement towards the weighted second end causes the cam portion 10 to transition from the resting position at approximately the proximate end 21 of the cam ramp 20, depicted in FIG. 1, to the pinching position at approximately the remote end 22 of the cam ramp 20, depicted in FIG. 2. When the cam portion 10 reaches the pinching position at approximately the remote end 22 of the cam ramp 20, the tension on the weighted second end of the rope will continue to cause the cam portion 10 to press against the rope, frictionally securing the rope between the cam portion 10 and the pinching portion 30 and forming the pinching point 40 shown in FIG. 2. The pinching portion 30 may move laterally to accommodate the width of the rope currently being secured in the apparatus. The pinching point 40 may be unformed when tension on the first end of the rope is greater than tension on the second end of the rope. After the pinching point 40 is unformed, the cam portion 10 returns to the resting position at approximately the proximate end 21 of the cam ramp 20 due to gravity, as shown in FIG. 3. The precise position of the cam portion 10 on the proximate end 21 and the remote end 22 of the cam ramp 20 may vary due to rope thickness and other factors.

Typical use of an exemplary embodiment of the rope arresting apparatus will now be described. A user will first apply tension to the first end of the rope so that tension on the first end of the rope is greater than tension on the second end of the rope. This tension applied by the user displaces the second end of the rope from an initial position. If the apparatus had previously secured the rope with the pinching point 40, the user applying appropriate tension to the first end of the rope will unform the pinching point 40 and release the rope, as described later.

The cam portion 10 remains in frictional contact with the rope as the user applies tension on the first end of the rope. After the user ceases to apply tension to the first end of the rope, tension on the second end of the rope may be greater than tension on the first end of the rope. The cam portion 10, which remained in frictional contact with the rope, is moved from a resting position, depicted in FIG. 1, towards a pinching position by the movement of the rope towards the weighted second end. The cam portion 10 traverses the cam ramp 20 from approximately the proximate end 21 to approximately the remote end 22. The cam portion 10 arrives at the pinching position and forms a pinching point 40 by pressing the rope against the pinching portion 30, depicted in FIG. 2. The pinching point 40 thus secures the rope and prevents the weighted second end of the rope from traveling any further. The user may release the rope from the pinching point 40 by applying appropriate tension on the first end of the rope so that tension on the first end is greater than tension on the second end of the rope. The user applied tension unforms the pinching point 40 by causing the cam portion 10 to move from the pinching position from the remote side 22 of the cam ramp 20 to the proximate end 21 of the cam ramp 20, releasing the rope and returning the rope arresting apparatus to the initial state.

A second exemplary embodiment will now be described. In the second exemplary embodiment, depicted in FIG. 4, the rope arresting apparatus 5 includes a housing 6, a pivot point 50, a cam portion 15, and a pinching portion 35. The housing 6 is fixed to a mounting surface.

The pivot point 50 connects the housing 6, the cam portion 15, and the pinching portion 35 together at a single point. The cam portion 15 and the pinching portion 35 are arranged to rotate around the pivot point 50 freely and independently while remaining attached to the housing 6.

Figure 4:
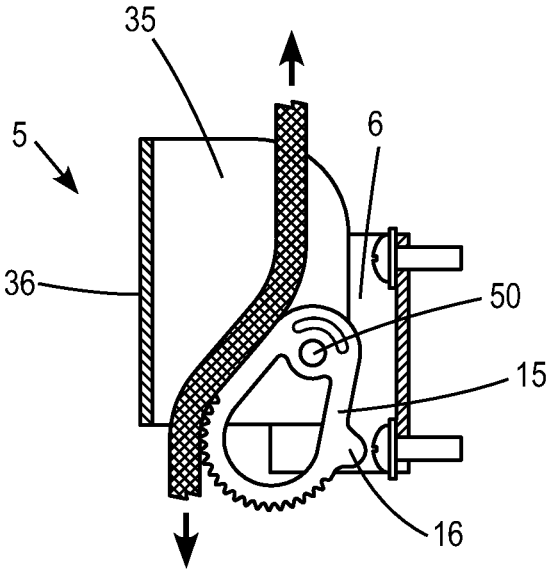
FIG. 4 depicts an embodiment of the rope arresting apparatus in an initial state.

The cam portion 15 is arranged to freely rotate about the pivot point 50, independent of the pinching portion 35. The cam portion 15 has a width less than the inner width of the pinching portion 35. The cam portion 15 includes a resting protrusion 16 arranged to allow the cam portion 15 at the resting position to maintain frictional contact with the rope. The cam portion 15 is at a resting position when the resting protrusion 16 rests against an inner surface of the housing 6, as depicted in FIGS. 4, 5*a*, and 6. The cam portion 15 is at a pinching position after rotating clockwise, as shown in FIGS. 5*a* and 5*b*, due to the movement of the rope. In further embodiments, the cam portion may be an oblong cam. In further embodiments, the cam portion may further comprise a set of surface protrusions. These protrusions may be of a predetermined size and length to exert frictional force on the rope while not damaging the rope. In still further embodiments, the cam portion surface protrusions may be arranged on the cam longitudinally, laterally, or in any orientation in between, to provide the appropriate amount of frictional force for securing the rope. The protrusions themselves may be formed by knurling or other known manufacturing processes.

The pinching portion 35 is arranged to freely rotate about the pivot point 50, independent of the cam portion 15. The pinching portion 35 is arranged within the housing 6 and has an outer width less than the inner width of the housing 6. The pinching portion 35 rotates freely about the pivot point 50 until its edges make contact with the inner wall of the housing 6, defining the first pinching portion position, shown in FIG. 5*a*, and the second pinching portion position, shown in FIG. 5*b*. The pinching portion includes an inner surface 36 adapted provide a surface for forming the pinching point 45 with the cam portion 15, described later. In further embodiments, the inner surface may further comprise a set of surface protrusions of a predetermined size and length to exert frictional force on the rope without damaging the rope. In still further embodiments, the pinching portion surface protrusions may be arranged on the pinching portion longitudinally, laterally, or in any orientation in between, to provide the appropriate amount of frictional force for securing the rope. The protrusions themselves may be formed by knurling or other known manufacturing processes. In still further embodiments the pinching portion may be a rocker or other similar structure suitable for forming pinching points with the cam portion.

The pinching point in the current exemplary embodiment will now be described. The pinching point 45 secures the rope and prevents the rope from sliding further towards the weighted second end of the rope. The pinching point 45 is formed when the cam portion 15 is urged towards the weighted second end of the rope while tension on the second end of the rope is greater than tension at the first end of the rope. The pinching portion 35 is arranged to provide a corresponding inner surface 36 to the cam portion 15. The inner surface 36 provides a surface against which the rope may be secured by the cam portion 15, forming the pinching point 45. The inner surface 36 and the cam portion 15 are both configured to provide sufficient frictional force to secure the rope at the pinching point 45. The cam portion 15 is released when the user lifts the pinching portion 35 to a third pinching portion position so that frictional contact between the rope and the cam portion 15 is broken.

The mode of operation of the current exemplary embodiment will now be described. The cam portion 15 at the resting position remains in frictional contact with the rope. The pinching portion 35 will rotate counterclockwise and make contact with the rope and cam portion 15, as shown in FIG. 5*a*, forming a pinching point 45 and defining the first pinching portion position. As tension on the first end of the rope becomes less than tension on the weighted second end of the rope, the pinching portion 35 and cam portion 15 rotate clockwise, moving the pinching point 45 clockwise about the pivot point 50 due to the movement of the rope towards the weighted second end. Rotation continues until the pinching portion 35 makes contact with the housing 6, preventing further rotation of the pinching portion 35 and defining the second pinching portion position depicted in FIG. 5*b*. The cam portion 15 may continue to rotate due to tension on the weighted second end of the rope being greater than tension on the first end of the rope until the rope is frictionally secured between the cam portion 15 and the pinching portion 35, forming the pinching point 45. The pinching point 45 is unformed by the user lifting the rope and breaking frictional contact with the cam portion 15, thus releasing the rope. As the user lifts the rope, the rope presses against the inner surface 36 and lifts the pinching portion 35. As the pinching portion 35 is lifted, the cam portion 15 maintains its position at approximately the second pinching portion position. The pinching portion 35 is eventually lifted so that the cam portion 15 is no longer in contact with the rope, thus unforming the pinching point 45. After the pinching point 45 is unformed, the cam portion 15 returns to the resting position due to gravity as depicted in FIG. 6.

Typical use of a second exemplary embodiment of the rope arresting apparatus will now be described. A user will first apply tension to the first end of the rope so that tension on the first end of the rope is greater than tension on the second end of the rope. This tension applied by the user at the first end of the rope displaces the second end of the rope from a resting position. If the apparatus had previously secured the rope, the user must first release the rope, as described later.

The cam portion 15 remains in frictional contact with the rope as the user applies tension on the first end of the rope. After the user has positioned the second end of the rope or when the user otherwise ceases to apply tension to the first end of the rope, tension on the second end of the rope may be greater than tension on the first end of the rope. The pinching portion 35 rotates about the pivot point 50 and makes contact with the rope at the first pinching point position. The pinching point 45 is formed when the cam portion 15 frictionally secures the rope against the pinching portion 35. The movement of the rope towards the weighted second end rotates the cam portion 15 and the pinching portion 35 clockwise around pivot point 50. The pinching point 45 also rotates around the pivot point 50 with the cam portion 15 and the pinching portion 35. The pinching portion 35 continues to rotate until it makes contact with the housing 6, thus arriving at the second pinching portion position and preventing further rotation of the pinching portion 35. The rope is secured when the pinching point 45 is formed at the second pinching portion position.

The user may then release the rope from the pinching point 45 formed by the cam portion 15 at a pinching point and the pinching portion 35 at the second pinching portion position by lifting the rope. As the rope is lifted, the rope is pressed against the inner surface 36, causing the pinching portion 35 to move to a third pinching portion position. As the pinching portion 35 moves to the third pinching portion position, frictional contact between the rope and the cam portion 15 is broken, thus unforming the pinching point 45 and releasing the rope. The cam portion 15 then rotates about the pivot point 50 and returns to a resting position as depicted in FIG. 6. The pinching portion 35 may then be moved from the third pinching portion position towards the first pinching portion position so that the user may comfortably apply tension to the first end of the rope and adjust the position of the weighted second end of the rope as necessary. In the current embodiment, the user merely applying tension at the first end of the rope greater than tension at the second end of the rope will not unform the pinching point and release the rope. Only after the user has moved the pinching portion 35 to a third pinching portion position will the rope be released.

The principles, exemplary embodiments, and mode of operation of the rope arresting apparatus have been described in the foregoing specification. The disclosure is not to be construed as limited to the particular embodiments disclosed. The embodiments described herein are to be regarded as illustrative rather than restrictive. Modifications, derivations, alterations, and equivalents will be readily apparent to those skilled in the art and are included in the scope of the disclosure, the following claims, and preceding drawings.

What is claimed is:

1. A rope arresting apparatus, for use with a rope having a first end and a weighted second end, where the first end is gripped by a user, the apparatus comprising:

a cam portion configured to exert frictional force on the rope, the cam portion having a resting position and a pinching position;

a pinching portion; and a pinching point formed when the cam portion at the pinching position engages the rope against the pinching portion, wherein the cam portion at the resting position is in frictional contact with the rope when tension on the weighted second end of the rope is less than or equal to tension on the first end of the rope, said frictional contact at the resting position being releasable by the user lifting the rope off of the cam portion while pressing the rope against the pinching portion.

2. The rope arresting apparatus of claim 1, wherein the cam portion comprises a set of cam portion surface protrusions of a predetermined size and length, the cam portion surface protrusions exerting frictional force on the rope.

3. The rope arresting apparatus of claim 2, further comprising:

a cam ramp portion comprising a proximate end and a remote end;

wherein the proximate end of the cam ramp portion causes frictional contact between the rope and the cam portion at the resting position when tension on the weighted second end of the rope is less than or equal to tension on the first end of the rope, wherein the remote end of the cam ramp portion causes frictional contact at the pinching point when tension on the weighted second end of the rope is greater than tension on the first end of the rope.

4. The rope arresting apparatus of claim 3, wherein the cam portion traverses from the cam portion resting position at the proximate end of the cam ramp portion to the cam portion pinching position at the remote end of the cam ramp portion when tension on the weighted second end of the rope is greater than tension on the first end of the rope.

5. The rope arresting apparatus of claim 4, wherein the cam portion traverses from the pinching position at the remote end of the cam ramp portion to the resting position at the proximate end of the cam ramp portion when tension on the weighted second end of the rope is less than or equal to tension on the first end of the rope.

6. The rope arresting apparatus of claim 5, wherein the cam portion traverses from the pinching position at the remote end of the cam ramp portion to the resting position at the proximate end of the cam ramp portion when the rope is not in frictional contact with the cam portion.

7. The rope arresting apparatus of claim 3, wherein the pinching portion is a pin positioned to form the pinching point with the cam portion at the pinching position when tension on the weighted second end of the rope is greater than tension on the first end of the rope.

8. The rope arresting apparatus of claim 3, wherein the cam portion is an unpinned roller.

9. The rope arresting apparatus of claim 3, wherein the cam ramp further comprises a set of ramp surface protrusions of a predetermined size and length, the ramp surface protrusions corresponding to the cam portion surface protrusions.

10. The rope arresting apparatus of claim 3, wherein the pinching point secures the rope.

11. The rope arresting apparatus of claim 3, wherein the pinching point is unformed and releases the rope when tension on the first end of the rope is greater than tension on the second end of the rope.

12. The rope arresting apparatus of claim 2, wherein the cam portion rotates about a pivot point from the resting position to the pinching position when tension on the weighted second end of the rope is greater than tension on the first end of the rope, wherein the cam portion rotates about the pivot point from the pinching position to the resting position when tension on the weighted second end of the rope is less than or equal to tension on the first end of the rope.

13. The rope arresting apparatus of claim 12, wherein the pinching portion rotates about the pivot point from a first pinching portion position towards a second pinching portion position when tension on the weighted second end of the rope is greater than tension on the first end of the rope.

14. The rope arresting apparatus of claim 13, wherein the pinching point is formed at the first pinching portion position, wherein the pinching point rotates about the pivot point towards the second pinching portion position.

15. The rope arresting apparatus of claim 13, wherein the pinching point at the second pinching portion position secures the rope.

16. The rope arresting apparatus of claim 13, wherein the pinching portion rotates to a third pinching portion position where the rope is not in frictional contact with the cam portion, unforming the pinching point and releasing the rope.

17. The rope arresting apparatus of claim 13, wherein the pinching portion is a rocker.

18. The rope arresting apparatus of claim 12, wherein the pinching portion rotates about the pivot point from the second pinching portion position to the first pinching portion position when tension on the weighted second end of the rope is less than or equal to tension on the first end of the rope.

19. The rope arresting apparatus of claim 12, wherein the cam portion is an oblong cam with a resting protrusion positioned to cause frictional contact with the rope when tension on the weighted second end of the rope is less than or equal to tension on the first end of the rope.

* * * * *